US006935728B2

(12) United States Patent
Kusunoki

(10) Patent No.: US 6,935,728 B2
(45) Date of Patent: Aug. 30, 2005

(54) INKJET HEAD AND INKJET RECORDING APPARATUS

(75) Inventor: Ryutaro Kusunoki, Mishima (JP)

(73) Assignee: Toshiba Tec Kabushiki Kaisha (JP)

( * ) Notice: Subject to any disclaimer, the term of this patent is extended or adjusted under 35 U.S.C. 154(b) by 132 days.

(21) Appl. No.: 10/657,943

(22) Filed: Sep. 9, 2003

(65) Prior Publication Data

US 2004/0113993 A1 Jun. 17, 2004

(30) Foreign Application Priority Data

Nov. 1, 2002 (JP) ..... 2002-320086

(51) Int. Cl.[7] ..... B41J 2/045; B41J 2/02
(52) U.S. Cl. ..... 347/68; 347/73
(58) Field of Search ..... 347/68–72, 73

(56) References Cited

U.S. PATENT DOCUMENTS 4,024,544 A * 5/1977 Vernon ..... 347/48
4,625,221 A * 11/1986 Mizuno et al. ..... 347/9
5,754,204 A * 5/1998 Kitahara ..... 347/70
6,382,754 B1 * 5/2002 Morikoshi et al. ..... 347/11
6,412,926 B1 * 7/2002 Okuda ..... 347/70

FOREIGN PATENT DOCUMENTS

| | | |
|---|---|---|
| EP | 07266552 | 10/1995 |
| EP | 1 129 853 A1 | 10/1999 |
| JP | 2000-117972 | 4/2000 |
| JP | 2002-19103 | 1/2002 |

OTHER PUBLICATIONS

Communication from European Patent Office re: counterpart application.

* cited by examiner

*Primary Examiner*—Manish S. Shah
*Assistant Examiner*—Geoffrey Mruk
(74) *Attorney, Agent, or Firm*—Harness, Dickey & Pierce, P.L.C.

(57) ABSTRACT

The inkjet recording apparatus having ink, where the inertia of ink in a flow passage is M, a viscosity resistance of the ink in the flow passage is R, and a return force of a meniscus is K in a nozzle, when the ink is charged in the flow passage composed of a nozzle and a pressure generating chamber, the physical properties of the ink and the share of the flow passage are set such that, a relationship of $0.2 \leqq \gamma^2/\omega^2 \leqq 1.0$ is satisfied, where $\omega=\sqrt{K/M}$ and $\gamma=R/2M$.

4 Claims, 4 Drawing Sheets

INKJET HEAD AND INKJET RECORDING APPARATUS

CROSS-REFERENCE TO RELATED APPLICATIONS

This application is based upon and claims the benefit of priority from the prior Japanese Patent Application No. 2002-320086, filed Nov. 1, 2002, the entire contents of which are incorporated herein by reference.

BACKGROUND OF THE INVENTION

1. Field of the Invention

The present invention relates to an on-demand inkjet head and an inkjet recording apparatus on which the inkjet head is mounted.

2. Description of the Related Art

There has been known an on-demand inkjet head for changing a pressure in a pressure generating chamber in which ink is charged by applying a voltage to a piezoelectric member, and discharging an ink drop from an opening of a nozzle communicating to the pressure generating chamber. However, it has been difficult to increase the printing speed while enhancing the stability of the ink discharge operation by the inkjet head of this type. Here, the stability of the ink discharge operation means a property that a variation in the speed of an ink drop to be discharged or a volume of an ink drop to be discharged is small.

In order to keep stabilization of the ink discharge operation, it is required that the variation of the meniscus position of the ink in the nozzle is reduced and the meniscus position is stabilized in the vicinity of the opening of the nozzle when the ink discharge operation is started.

On the other hand, a frequency of the ink drop to be discharged has only to be increased in order to increase the printing speed. In order to increase the drive frequency of the ink drop to be discharged, it is required that the speed at which the meniscus retracted by the ink discharge operation is returned to the original position, that is a meniscus return speed is improved. However, when the meniscus return speed is improved, the meniscus overshoots from the opening of the nozzle due to inertia of an ink flow along with the return of the meniscus. Therefore, the meniscus position is easily unstable in the vicinity of the opening of the nozzle. When the ink discharge operation is started in a state where the meniscus position is unstable, the discharge speed or the discharge volume is fluctuated, or the ink not-discharged phenomenon occurs in some cases, so that the stability of the discharge operation is easily lost. In this manner, it has been difficult to achieve both the stability of the meniscus position and the improvement of the meniscus return speed.

In order to solve such problems, there is disclosed (for example, refer to Jpn. Pat. Appln. KOKAI Publication No. 2000-117972) a technique where, assuming that a relationship between the properties of the ink and the shape of the ink flow passage is prescribed and the maximum drive frequency is 10 kHz in order to realize the target printing speed, both the stability of the meniscus position and the improvement of the meniscus return speed can be achieved even when the environment temperature changes.

However, in the conventional technique disclosed in this patent reference, it becomes clear from a simulation by the present inventor that, when the target maximum drive frequency is made higher than 10 kHz, overshooting of the meniscus largely occurs.

In other words, the present inventor has performed the simulation of an operation for discharging one ink drop using the following numerical values as characteristic values in the numerical range indicated in this conventional technique.

Total inertance $mT=9.8\times10^{7}$ [kg/m$^{4}$]

Total acoustic resistance $rT=6.7\times10^{12}$ [Ns/m$^{5}$]

Surface tension of ink=30 [mN/m]

When a variation in the meniscus position after the completion of the ink discharge operation is found by this simulation, a result indicated by a solid line P in FIG. 12 is obtained.

A meniscus volume position v(t) in FIG. 12 is a value where a position of the meniscus is expressed by a volume. As shown in FIG. 13A, when the meniscus of ink 1 is retracted from an opening 2*a* of a nozzle 2, a volume Vi of air in the opening 2*a* of the nozzle 2 is assumed to be a negative value of the meniscus volume position. Further, as shown in FIG. 13B, when the meniscus of the ink 1 is advanced from the opening 2*a* of the nozzle 2, a volume Vo of the ink which is projected from the opening 2*a* of the nozzle 2 is assumed to be a positive value of the meniscus volume position.

In FIG. 12, dotted lines S1 and S2 indicate an allowable range of the meniscus volume position v(t) which does not affect the operational stability when the next ink discharge operation is started. In the case of the printing condition generally used, when the allowable range is ±5% relative to the discharge volume, the discharge stability can be obtained. Here, the grounds for ±5% is based on a numerical range where those skilled in the art regard allowable limits that image quality is not deteriorated.

Therefore, as can be seen from FIG. 12, in the inkjet head disclosed in this conventional technique, the overshooting of the meniscus after ink is discharged is large, and a time until the variation in the meniscus falls into the prescribed allowable range, that is the meniscus return time is long. Thus, it is difficult to improve the drive frequency for discharging ink while keeping the stabilization of the ink discharge operation.

In the meantime, there has been conventionally known a technique for continuously discharging a plurality of small ink drops as a technique for performing gradation printing (for example, refer to Jpn. Pat. Appln. KOKAI Publication No. 2002-19103). The present inventor applies this technique to the inkjet head of the conventional technique and performs a simulation of the discharge operation when seven ink drops correspond to the maximum dot diameter in gradation printing are continuously discharged to find a variation in the meniscus position after the completion of the ink discharge operation. Therefore, a result indicated by a double-chain line Q in FIG. 12 is obtained.

As shown in FIG. 12, when a plurality of small ink drops are continuously discharged, the meniscus return speed is faster as compared with a case where only one ink drop is discharged. Thus, the overshooting of the meniscus after ink is discharged is more pronounced than that in the case where only one ink drop is discharged. Therefore, when a plurality of small ink drops are continuously discharged to perform gradation printing, it is further difficult to reduce the meniscus return time.

As described above, in the conventional inkjet head of this type, is has been difficult to increase the printing speed, that is, to discharge ink at a high drive frequency, while enhancing the stability of the ink discharge operation.

BRIEF SUMMARY OF THE INVENTION

It is an object of the present invention to provide an inkjet head capable of enhancing the stability of an ink discharge operation and discharging ink at a high drive frequency, and an inkjet recording apparatus on which the inkjet head is mounted.

According to one aspect of the present invention, there is provided an inkjet head comprising: a plurality of flow passages each composed of a nozzle to discharge ink and a pressure generating chamber communicating to the nozzle; a common ink chamber which supplies ink to each of the flow passages; and an actuator which expands/contracts a volume of the pressure generating chamber, wherein the physical properties of the ink and the flow passage satisfy a relationship of $0.2 \leqq \gamma^2/\omega^2 \leqq 1.0$ ($\gamma = R/2M$, $\omega = \sqrt{K/M}$, where M is inertia of the ink in the flow passage when the ink is charged in the flow passage, and R is a viscosity resistance of the ink in the flow passage).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, embodiments according to the present invention will be described using the drawings. At first, a first embodiment of the invention will be described using FIGS. 1 to 6.

Figure 1:
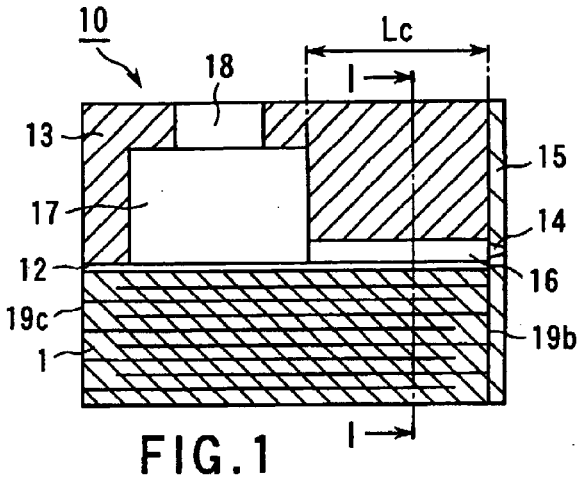
FIG. 1 is a longitudinal section view of an inkjet head according to a first embodiment of the present invention.
Figure 2:
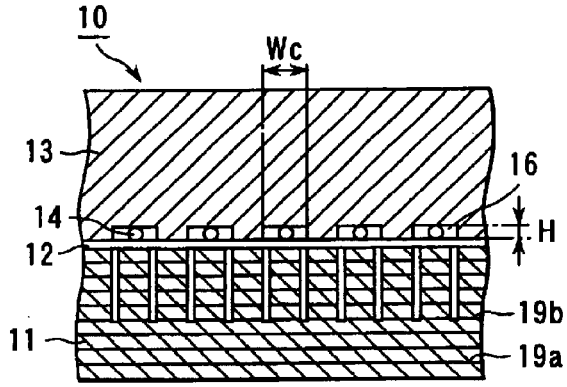
FIG. 2 is a section view taken along the line I—I in FIG. 1.

FIG. 1 is a longitudinal section view of an inkjet head 10, and FIG. 2 is a section view taken along the line I—I in FIG. 1. An actuator 11 composed of a piezoelectric member on a substrate (not shown) for expanding/contracting a volume of a pressure chamber is fixed on this inkjet head 10. A vibration plate 12 is mounted on this actuator 11. A top plate 13 is fixed on this vibration plate 12. Further, a nozzle plate 15 where a plurality of nozzles 14 for discharging ink are formed is attached on the front ends of the top plate 13 and the actuator 11.

Figure 3:
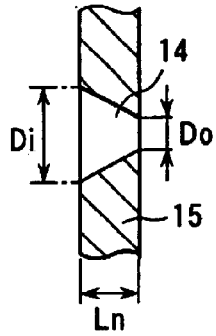
FIG. 3 is a detailed view showing a nozzle portion in FIG. 1.

FIG. 3 shows details of the nozzle 14. As illustrated, the nozzle 14 is formed with an opening having a diameter Do and an opening having a diameter Di (Di>Do) at the front face side of the nozzle plate 15 having a plate thickness Ln and at the rear face side thereof, respectively, where both the openings are formed in a communicating manner.

In the top plate 13, a plurality of pressure generating chambers 16 indicated by a length Lc, a width Wc, and a height H are formed in correspondence to the respective nozzles 14 formed in the nozzle plate 15. A tip end of each pressure generating chamber 16 is communicated to a rear end of each corresponding nozzle 14. Further, a common ink chamber 17 for supplying ink to each pressure generating chamber 16 is formed in the top plate 13, and a rear end of each pressure generating chamber 16 is communicated to the common ink chamber 17. An ink replenishment port 18 is formed in the common ink chamber 17. Ink is supplied by ink replenishing means (not shown) through this ink replenishment port 18.

Electrodes 19*a* and 19*b* are provided in the actuator 11. The actuator 11 is expanded/contracted according to a voltage applied to these electrodes 19*a* and 19*b*. When the actuator 11 is expanded/contracted, a volume of the pressure generating chamber 16 is expanded/contracted via the vibration plate 12. When contraction occurs after the volume of the pressure generating chamber 16 is expanded, a pressure of ink charged in the pressure generating chamber 16 is changed so that an ink drop is discharged from the nozzle 14. The nozzle 14 and the pressure generating chamber 16 corresponding thereto make a flow passage of ink which is supplied from the common ink chamber 17.

Figure 4:
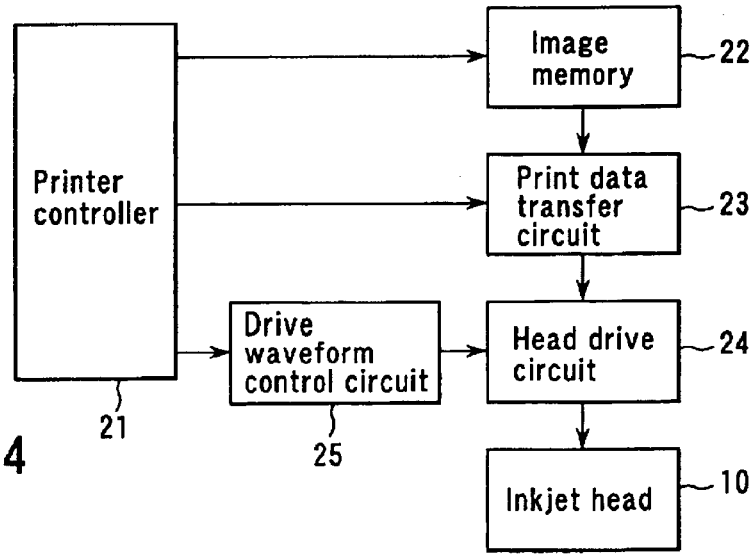
FIG. 4 is a block diagram showing an essential structure of an inkjet recording apparatus according to the first embodiment.

FIG. 4 is a block diagram showing an essential structure of an inkjet recording apparatus 20 on which the inkjet head 10 having such a structure is mounted. The inkjet recording apparatus 20 comprises a printer controller 21 for controlling each portion, an image memory 22 for storing print data from this printer controller 21 therein, and a print data transfer circuit 23 for reading print data stored in the image memory 22 and transferring it to a head drive circuit 24. The head drive circuit 24 is configured to drive the inkjet head 10 on the basis of the print data transferred from the print data transfer circuit 23. A drive waveform when the head drive circuit 24 drives the inkjet head 10 is controlled by a drive waveform control circuit 26. The drive waveform control circuit 26 is configured to be controlled by the printer controller 21. And conveying a recording medium (not shown) is controlled by the printer controller 21.

Figure 5:
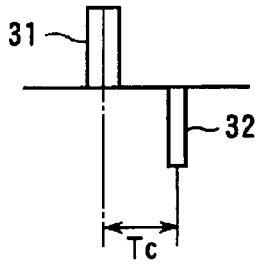
FIG. 5 is a waveform diagram showing a drive waveform to be applied to the inkjet head according to the first embodiment.

According to the first embodiment, FIG. 5 shows a drive waveform to be applied to the inkjet head 10. This drive waveform is composed of an expansion pulse 31 for expanding the pressure generating chamber 16 of the inkjet head 10 and a contraction pulse 32 for contracting the pressure generating chamber 16. When these pulses are applied to the electrodes 19*a* and 19*b* of the inkjet head 10, an operation for discharging one ink drop is performed.

Here, a time difference between the center of the expansion pulse 31 and the center of the contraction pulse 32 coincides with a main acoustic resonance cycle Tc of the ink. Further, a ratio between a pulse width of the expansion pulse 31 and a pulse width of the contraction pulse 32 is adjusted such that acoustic residual vibration is almost cancelled. By doing so, a variation in a meniscus position after the ink discharge operation is not disturbed due to the residual pressure vibration, and the variation in the meniscus position is only a relatively low-speed motion caused by the surface tension of the ink.

In the inkjet head 10 mounted on the inkjet recording apparatus having such a structure, a motion of the meniscus after an ink drop is discharged until the meniscus is returned will be described below.

Assuming that a meniscus volume position at a time t is v(t), an equation of motion relating to v(t) is expressed by the following equation (1):

$$M\frac{d^2 v(t)}{dt^2} = -Kv(t) - R\frac{dv(t)}{dt} \tag{1}$$

Here, the meniscus volume position is assumed such that, when the meniscus of ink 1 is retracted from an opening 2*a* of a nozzle 2, a volume Vi of the air in the opening 2*a* of the nozzle 2 is a negative value of the meniscus volume position, and when the meniscus of the ink 1 is advanced from the opening 2*a* of the nozzle 2, an ink volume Vo equal to a projecting amount from the opening 2*a* of the nozzle 2 is a positive value of the meniscus volume position.

In the equation (1), M indicates inertia of the ink in the flow passage. Assuming that ρ is a density of the ink, Lc is a length of the pressure generating chamber 16, Ln is a length of the nozzle 14, and S(x) is a section area of the flow passage at a position x, a value of M is given by the following equation (2):

$$M = \rho\int_0^{Lc+Ln}\frac{dx}{S(x)} \tag{2}$$

Further, K indicates a return force of the meniscus and is defined by the following equation (3) assuming that the meniscus volume position is V and a pressure generated on a surface of the meniscus by the surface tension of the ink is Ps:

$$K = \lim_{v\to 0}\frac{Ps}{v} \tag{3}$$

Assuming that the surface tension of the ink is σ and a curvature radius of the meniscus is r, the pressure Ps is calculated from the following equation (4):

$$Ps = \frac{2\sigma}{r} \tag{4}$$

Assuming that an outlet port diameter of the nozzle is Do, the curvature radius r of the meniscus is calculated from the following equation (5) as the function of the meniscus volume position v:

$$r = \frac{1}{192v}\left(\sqrt[3]{\frac{\xi}{\pi}} + \frac{Do^8\pi^{7/3}}{\sqrt[3]{\xi}} + Do^4\pi\right) \tag{5}$$

ξ is expressed by the following equation (6):

$$\xi = \pi^4 Do^{12} + 4608\pi^2 v^2 Do^6 + 2654208v^4 + 96(\pi^2 vDo^6 + 1152v^3)\sqrt{\pi^2 Do^6 + 576v^2} \tag{6}$$

The return force K of the meniscus can be calculated as the following equation (7) from the above equations (3) to (6):

$$K = \frac{384\sigma}{3\pi Do^4} \tag{7}$$

Further, R indicates a viscosity resistance of the ink in the flow passage. Assuming that a viscosity pressure gradient per unit flow amount at the position x is r(x), a value of R is given by the following equation (8):

$$R = \int_0^{Lc+Ln} r(x)dx \tag{8}$$

With respect to the inkjet head 10, the right terms of the equation (2) and the equation (8) are specifically calculated. At first, the right term of the equation (2) is expressed by the following equation (9) and the right term of the equation (8) is expressed by the following equation (10) in a range where the position x is 0 to Lc, that is, in the portion of the pressure generating chamber 16 of the flow passage:

$$\int_0^{Lc}\frac{dx}{S(x)} = \frac{Lc}{WcH} \tag{9}$$

$$\int_0^{Lc} r(x)dx = \frac{12\mu Lc}{WcH^3} \tag{10}$$

Further, the right term of the equation (2) is expressed by the following equation (11) and the right term of the equation (8) is expressed by the following equation (12) in a range where the position x is Lc to Lc+Ln, that is, in the portion of the nozzle 14 of the flow passage:

$$\int_{Lc}^{Lc+Ln}\frac{dx}{S(x)} = \frac{4Ln}{\pi DiDo} \tag{11}$$

$$\int_{Lc}^{Lc+Ln} r(x)dx = \frac{128\mu(Di^2 + DiDo + Do^2)Ln}{3\pi(DiDo)^3} \tag{12}$$

The ink inertia M in the equation (2) is expressed by the following equation (13) and the ink viscosity resistance R in the equation (8) is expressed by the following equation (14) from the above equations (9), (10), (11), and (12):

$$M = \rho\left(\frac{Lc}{WcH} + \frac{4Ln}{\pi DiDo}\right) \tag{13}$$

$$R = \mu\left\{\frac{12Lc}{WcH^3} + \frac{128(Di^2 + DiDo + Do^2)Ln}{3\pi(DiDo)^3}\right\} \tag{14}$$

A coefficient ω is defined as the following equation (15) and a coefficient γ is defined as the following equation (16)

on the basis of the ink inertia M, the return force K of the meniscus, and the ink viscosity resistance R defined in the above manner:

$$\omega = \sqrt{\frac{K}{M}} \tag{15}$$

$$\gamma = \frac{R}{2M} \tag{16}$$

Thus, the above equation (1) which is the equation of motion of the meniscus can be expressed by the following equation (17):

$$\frac{d^2 v(t)}{dt^2} + 2\gamma\frac{dv(t)}{dt} + \omega^2 v(t) = 0 \tag{17}$$

A solution of the meniscus volume position v(t) in this equation (17) is the following equation (18), where A and B are arbitrary constants:

$$v(t)=Ae^{(-\gamma+\sqrt{\gamma^2-\omega^2})t}+Be^{(-\gamma-\sqrt{\gamma^2-\omega^2})t} \tag{18}$$

According to this equation (18), since the meniscus volume position v(t) obtains a vibration solution in the case of $\gamma^2-\omega^2<0$, it can be seen that the meniscus overshoots.

Figure 6A:
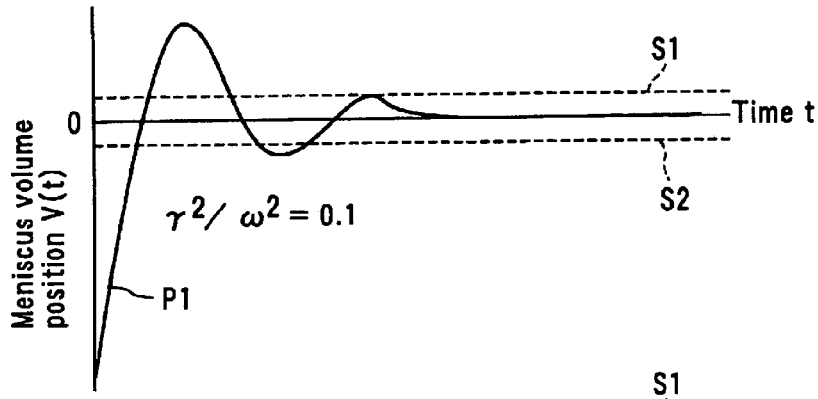
FIGS. 6A to 6D are diagrams showing a relationship between a value of $\gamma^2/\omega^2$ and a return motion of a meniscus according to the first embodiment.
Figure 6B:
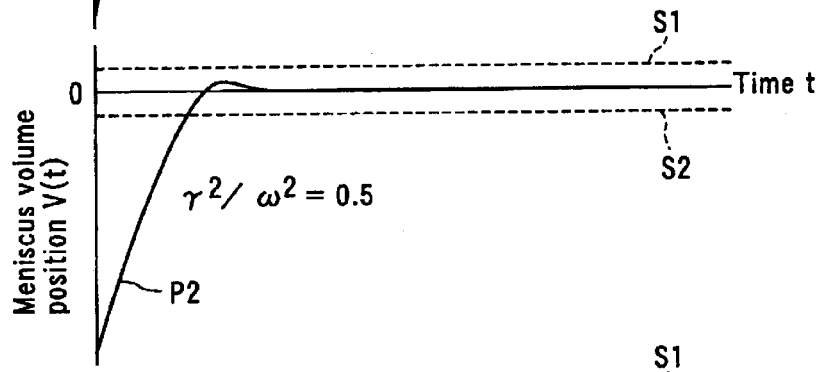
Figure 6C:
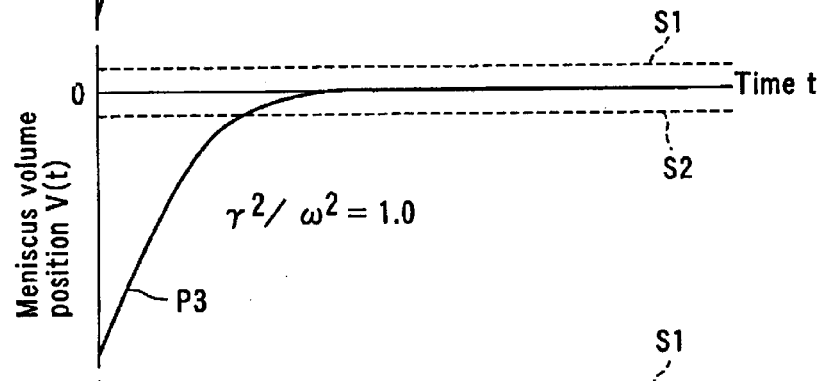

As one example of $\gamma^2-\omega^2<0$, when a variation in the meniscus position after the completion of the ink discharge operation when a simulation of the operation for discharging one ink drop is performed is found assuming $\gamma^2/\omega^2=0.1$ a result indicated by a solid line P1 in FIG. 6A is obtained. Further, as another example of $\gamma^2-\omega^2<0$, when a variation in the meniscus position after the completion of the ink discharge operation when a similar simulation is performed is found assuming $\gamma^2/\omega^2=0.5$, a result indicated by a solid line P2 in FIG. 6B is obtained. Further, when a variation in the meniscus position after the completion of the ink discharge operation when a similar simulation is performed is found assuming $\gamma^2=\omega^2$, that is $\gamma^2/\omega^2=1.0$, a result indicated by a solid line P3 in FIG. 6C is obtained. Furthermore, as one example of $\gamma^2-\omega^2>0$, a variation in the meniscus position after the completion of the ink discharge operation when a similar simulation is performed is found assuming $\gamma^2/\omega^2=2.0$, a result indicated by a solid line P4 in FIG. 6D is obtained.

Dotted lines S1 and S2 in FIG. 6 indicate an allowable range of the variation in the meniscus which does not affect the operational stability when the ink discharge operation is started, and the range is within ±5% relative to the discharge volume. This is because, when the allowable range is within ±5% relative to the discharge volume, the discharge stability can be obtained under the printing conditions generally used.

Figure 6D:
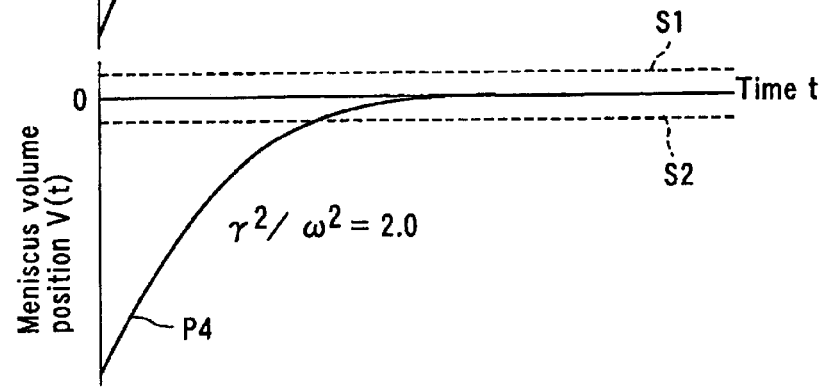

As shown in FIG. 6D, in the case of $\gamma^2-\omega^2>0$, that is $\gamma^2/\omega^2>1$, the meniscus volume position v(t) is in an overdamping state, and the return speed of the meniscus is delayed although the meniscus does not overshoot. Further, as shown in FIGS. 6A and 6B, in the case of $\gamma^2-\omega^2<0$, that is $\gamma^2/\omega^2<1$, the meniscus volume position v(t) is in a damping vibration state, and the meniscus overshoots although the return speed of the meniscus is fast. On the contrary, in the case of $\gamma^2=\omega^2$, that is $\gamma^2/\omega^2=1$, the meniscus volume position v(t) is in a critical damping state, and the return speed of the meniscus becomes fastest under a condition where the meniscus does not overshoot.

Therefore, it can be seen that the return speed of the meniscus can be made fastest in a range where the overshooting of the meniscus does not occur in the case of $\gamma^2=\omega^2$. However, actually, as in the case of $\gamma^2/\omega^2=0.5$, when the overshooting is slight, it is allowable. A time until the variation in the meniscus falls into an allowable value, that is, the return time of the meniscus, can thus be reduced.

Figure 7:
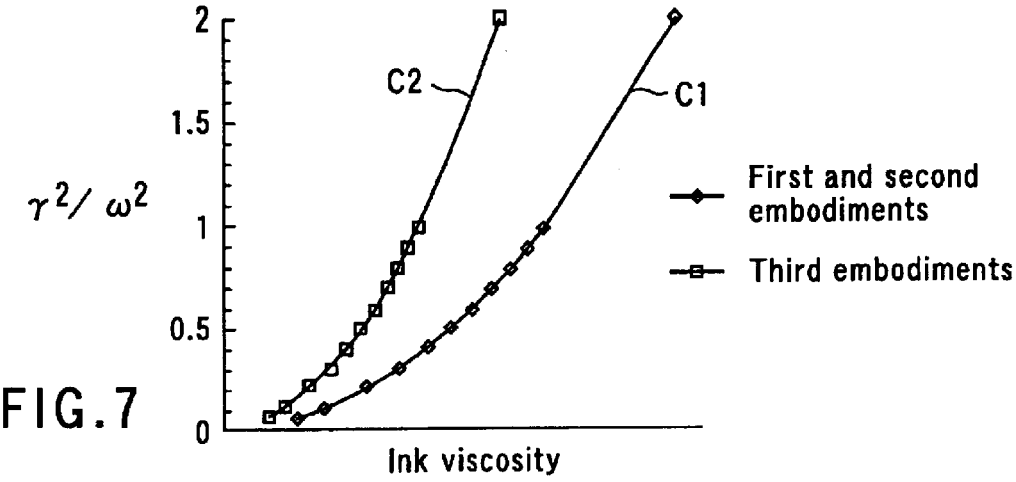
FIG. 7 is a diagram showing a relationship between an ink viscosity and a value of $\gamma^2/\omega^2$.
Figure 8:
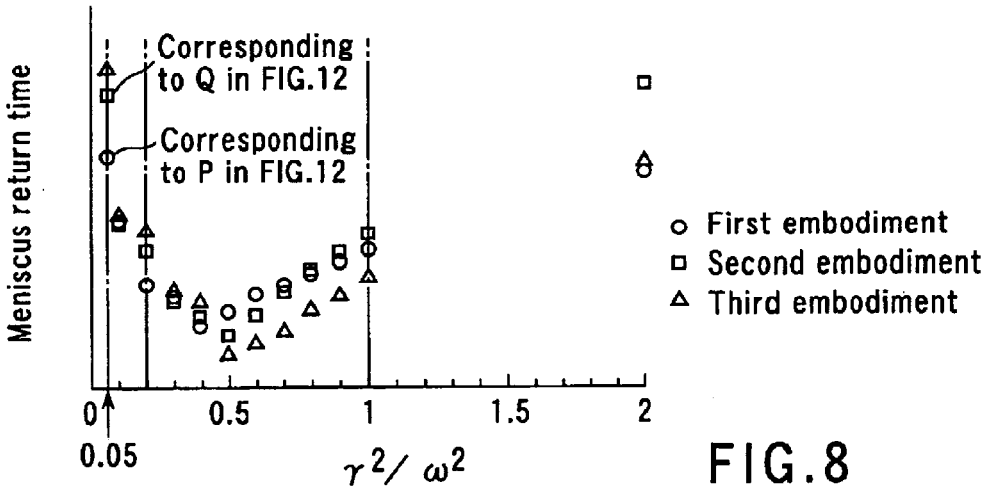
FIG. 8 is a diagram showing a relationship between a value of $\gamma^2/\omega^2$ and a return time of a meniscus.

As shown in a curved line Cl in FIG. 7, when the return time of the meniscus is examined by changing the ink viscosity to change a value of $\gamma^2/\omega^2$, a value indicated by "○" in FIG. 8 is taken. It can be seen from this value that the return time of the meniscus is made shortest when $\gamma^2/\omega^2$ is 0.4 in the first embodiment.

Therefore, according to the first embodiment, in order to obtain $\gamma^2/\omega^2=0.4$, the physical properties of the ink and the shape of the flow passage are set to configure the inkjet head 10 such that the ink inertia M, the ink viscosity resistance R, and the return force K of the meniscus have the following values, respectively, thereby reducing the return time of the meniscus.

Ink inertia $M=9.82\times10^7$ kg/m$^4$

Ink viscosity resistance $R=1.90\times10^{13}$ Ns/m$^5$

Return force K of meniscus $=2.30\times10^{18}$ N/m$^5$

As a result, both the stability of the ink discharge operation and the improvement of the drive frequency, that is, the speedup of the printing speed can be achieved.

In other words, according to the present invention, the return force K of the meniscus which has not conventionally been considered is used as one parameter for optimizing the ink inertia M and the ink viscosity resistance R so that a relationship between the physical properties of the ink and the flow passage capable of achieving both the stability of the ink discharge operation and the improvement of the drive frequency, that is, the speedup of the printing speed can be derived by performing the simulation described above.

In addition, as a result of the simulation using the numerical values disclosed in the conventional technique described above, Ink inertia $M=9.82\times10^7$ kg/m$^4$, Ink viscosity resistance $R=6.94\times10^{12}$ Ns/m$^5$, and Return force K of meniscus$=2.30\times10^{18}$ N/m$^5$ are obtained. From these values, $\gamma^2/\omega^2=0.05$ can be obtained. This value corresponds to a case where the return time of the meniscus when the ink is discharged is $\gamma^2/\omega^2=0.05$ in a series of the first embodiment in FIG. 8.

Therefore, as can be seen from FIG. 8, it is apparent that the return time of the meniscus can be remarkably reduced in the present invention as compared with the conventional technique in the range where $\gamma^2/\omega^2$ is set to be 0.2 to 1.0, thereby improving the printing speed while keeping the stability of the ink discharge operation.

Next, a second embodiment according to the present invention will be described. In this second embodiment, the structures of the inkjet head and the inkjet recording apparatus are identical to those in the first embodiment, and the description thereof will be omitted by using FIGS. 1 to 4.

Figure 9:
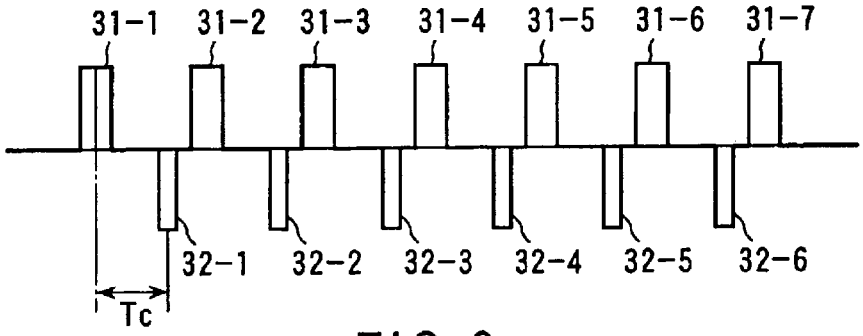
FIG. 9 is a waveform diagram showing a drive waveform to be applied to an inkjet head according to a second embodiment of the present invention.

According to the second embodiment, a drive waveform to be applied to the inkjet head 10 by control of the drive waveform control circuit 26 which is drive signal generating means is set as a waveform shown in FIG. 9. This waveform is formed by continuously linking seven drive waveforms used in the first embodiment. In other words, the expansion pulses 31-1 to 31-7 expand the pressure generating chamber 16, and the contraction pulses 32-1 to 32-7 contract the pressure generating chamber 16. When this drive waveform is applied to the electrodes 19*a* and 19*b* of the inkjet head 10, seven small ink drops are continuously discharged from the nozzle 14 and deposited in the same pixel on a recording medium. If the number of small ink drops is changed to change the amount of ink to be deposited in the same pixel on the recording medium, gradation printing can be performed.

Also in this second embodiment, when a simulation similar to that in the first embodiment is performed, the ink viscosity is changed as shown in the curved line C1 in FIG. 7 to change the value of $\gamma^2/\omega^2$, and the return time of the meniscus is examined, a value indicated by a symbol of "□" in FIG. 8 is taken. It can be seen from this value that the return time of the meniscus is shortest when $\gamma^2/\omega^2$ is 0.5 in the second embodiment.

Therefore, according to the second embodiment, in order to obtain $\gamma^2/\omega^2=0.5$, the physical properties of the ink and the shape of the flow passage are set to configure the inkjet head 10 such that the ink inertia M, the ink viscosity resistance R, and the return force K of the meniscus have the following values, respectively, thereby reducing the return time of the meniscus and achieving both the stability of the ink discharge operation and the speedup of the printing speed.

Ink inertia $M=9.82\times10^7$ kg/m$^4$

Ink viscosity resistance $R=2.13\times10^{13}$ Ns/m$^5$

Return force K of meniscus$=2.30\times10^{18}$ N/m$^5$

In this manner, according to the second embodiment where a plurality of ink drops are continuously discharged from the nozzle 14, the return time of the meniscus can be reduced as compared with the first embodiment where one ink drop is discharged. This is due to the fact that, when a plurality of ink drops are continuously discharged, the return speed of the meniscus is larger as compared with the case where only one ink drop is discharged. In the conventional technique, the return speed of the meniscus is so large that the overshooting is made larger and the return time of the meniscus is longer than that in the case where only one ink drop is discharged. But, since the overshooting of the meniscus is restricted according to the present embodiment, there can be obtained a synergistic effect that the return time of the meniscus is made shorter than that in the case where only one ink drop is discharged.

As a result of the simulation using the numerical values disclosed in the conventional technique described above, $\gamma^2/\omega^2=0.05$ is obtained as described in the description of the first embodiment.

The return time of the meniscus when a plurality of ink drops are discharged in this inkjet head corresponds to a case where $\gamma^2/\omega^2=0.05$ in a series of the second embodiment in FIG. 8.

Therefore, as can be seen from FIG. 8, it is apparent that the return time of the meniscus can be greatly reduced in the present invention as compared with the conventional technique in the range where $\gamma^2/\omega^2$ is set to be 0.2 to 1.0, thereby improving the printing speed while keeping the stability of the ink discharge operation.

Next, a third embodiment according to the present invention will be described.

Figure 10:
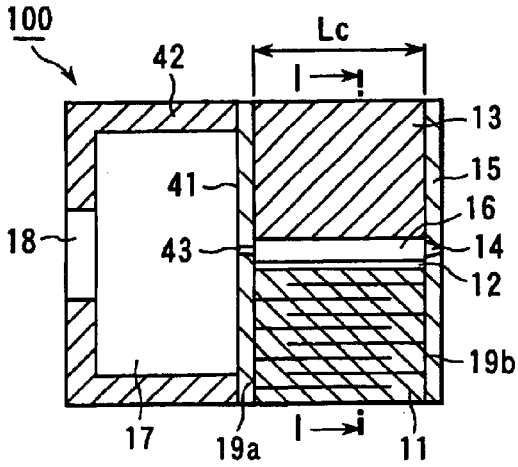
FIG. 10 is a longitudinal section view of an inkjet head according to a third embodiment of the present invention.

FIG. 10 is a longitudinal section view of an inkjet head 100 according to the third embodiment, where portions having the same functions as those in FIG. 1 are denoted with like numerals. Since the section view taken along the line I—I in FIG. 10 of the inkjet head 100 is identical to that of the inkjet head 10 according to the first and second embodiments, the description thereof will be omitted by using FIG. 2.

The actuator 11 composed of a piezoelectric member on a substrate (not shown) is fixed on this inkjet head 100, the vibration plate 12 is mounted on the actuator 11, and the top plate 13 is fixed on the vibration plate 12. Further, the nozzle plate 15 where a plurality of nozzles 14 for discharging ink are formed is attached on the front ends of the top plate 13 and the actuator 11. A plurality of pressure generating chambers 16 are formed in the top plate 13 in correspondence to the respective nozzles 14 formed in the nozzle plate 15, and a tip end of each pressure generating chamber 16 is communicated to a rear end of each corresponding nozzle 14.

Figure 11:
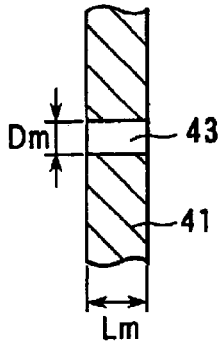
FIG. 11 is a detailed view showing an orifice portion in FIG. 10.
Figure 12:
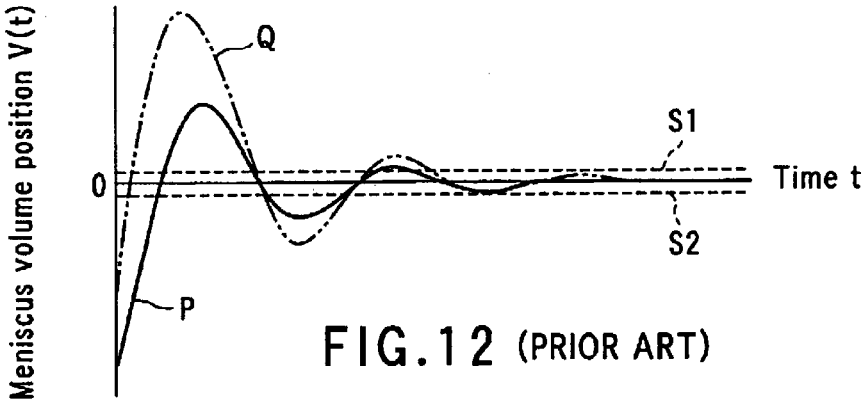
FIG.12 (PRIOR ART)
FIG. 12 is a diagram showing a return motion of a meniscus in a conventional inkjet head.
Figure 13A:
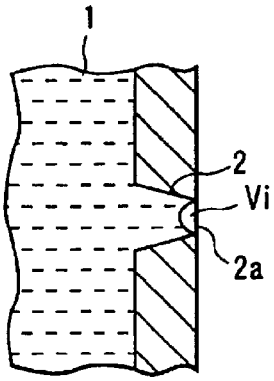
FIGS. 13A and 13B are schematic diagrams for explaining a meniscus volume position.
Figure 13B:
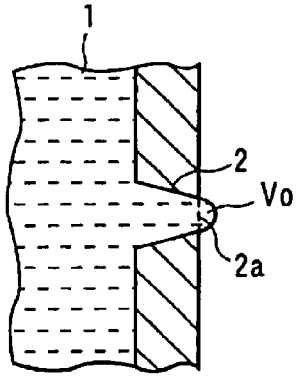

A side plate 42 is fixed on the rear ends of the top plate 13 and the actuator 11 via an orifice plate 41. An orifice 43 having a small hole at a position corresponding to each pressure generating chamber 16 is drilled in the orifice plate 41. The details of the orifice 43 are shown in FIG. 11. As illustrated, the orifice 43 is formed to penetrate from a rear face side of the orifice plate having a plate thickness Lm to a front face side thereof with a constant diameter Dm.

The common ink chamber 17 for supplying ink to each pressure generating chamber 16 is formed in the side plate 42, and a rear end of each pressure generating chamber 16 is communicated to the common ink chamber 17 via the orifice 43. The ink replenishment port 18 is formed in the common ink chamber 17, and ink is supplied by the ink replenishing means (not shown) through this ink replenishment port 18. Here, the orifice 43 forms part of the flow passage of the ink supplied from the common ink chamber 17 and acts as a fluid resistor.

An essential structure of the inkjet recording apparatus 20 on which the inkjet head 100 is mounted is identical to that in FIG. 4. According to the third embodiment, the drive waveform shown in FIG. 9 is applied to the inkjet head 100 and seven small ink drops are continuously discharged from the nozzle 14 so that the gradation printing is performed similarly to the second embodiment.

In this case, when the ink inertia M and the ink viscosity resistance R are calculated, a resistance component caused by the orifice 43 is required to be added. In other words, assuming that a length of the orifice 43 is Lm, the ink inertia M is given by the following equation (19) instead of the above equation (2):

$$M = \rho \int_0^{Lm+Lc+Ln} \frac{dx}{S(x)} \tag{19}$$

Further, the ink viscosity resistance R is given by the following equation (20) instead of the above equation (8):

$$R = \int_0^{Lm+Lc+Ln} r(x)\,dx \tag{20}$$

The right terms of the equation (19) and the equation (20) are specifically calculated with respect to the inkjet head 100. At first, assuming that a hole diameter of the orifice 43 is Dm, the right term of the equation (19) is expressed by the following equation (21) and the right term of the equation (20) is expressed by the following equation (22) in the range where the position x is 0 to Lm, that is, in the portion of the orifice 43 in the flow passage:

$$\int_0^{Lm} \frac{dx}{S(x)} = \frac{4Lm}{\pi Dm^2} \tag{21}$$

$$\int_0^{Lm} r(x)\,dx = \frac{128\mu Lm}{\pi Dm^4} \tag{22}$$

Further, since the right terms of the equation (19) and the equation (20) are identical to those in the first embodiment in the range where the position x is Lm to Lm+Lc, that is, in the portion of the pressure generating chamber 16 in the flow passage, and in the range where the position x is Lm+Lc to Lm+Lc+Ln, that is in the portion of the nozzle 14 in the flow passage, the right term of the equation (19) where x is Lm to Lm+Lc+Ln is expressed by the above equations (9) and (11), and the right term of the equation (20) where x is Lm to Lm+Lc+Ln is expressed by the above equations (10) and (12).

The ink inertia M in the equation (19) is expressed by the following equation (23) and the ink viscosity resistance R in the equation (20) is expressed by the following equation (24) from the above equations (21), (22), (9), (10), (11), and (12):

$$M = \rho\left(\frac{4Lm}{\pi Dm^2} + \frac{Lc}{WcH} + \frac{4Ln}{\pi DiDo}\right) \tag{23}$$

$$R = \mu\left\{\frac{128Lm}{\pi Dm^4} + \frac{12Lc}{WcH^3} + \frac{128(Di^2 + DiDo + Do^2)Ln}{3\pi(DiDo)^3}\right\} \tag{24}$$

In addition, the return force K of the meniscus can be obtained by the above equation (7).

Also in the third embodiment, when a simulation similar to that in the first and second embodiments is performed, the ink viscosity is changed as shown by curved line C2 in FIG. 7 to change the value of $\gamma^2/\omega^2$, and the return time of the meniscus is examined, a value indicated by a symbol of "Δ" in FIG. 8 is taken. It can be seen from this value that the return time of the meniscus is shortest when $\gamma^2/\omega^2$ is 0.5 in the third embodiment.

Therefore, according to the third embodiment, in order to obtain $\gamma^2/\omega^2=0.05$, the physical properties of the ink and the shape of the flow passage are set to configure the inkjet head 100 such that the ink inertia M, the ink viscosity resistance R, and the return force K of the meniscus have the following values, respectively, thereby further reducing the return time of the meniscus and achieving both the stability of the ink discharge operation and the speedup of the printing speed.

Ink inertia $M=1.13\times10^8$ kg/m$^4$

Ink viscosity resistance $R=2.28\times10^{13}$ Ns/m$^5$

Return force K of meniscus$=2.30\times10^{18}$ N/m$^5$

In this manner, according to the third embodiment where the orifice 43 which acts as the fluid resistor is intervened in the passage communicating the common ink chamber 17 and the pressure generating chamber 16, the return time of the meniscus can be reduced as compared with the first and second embodiments. This is because, even when the ink inertia M is not made too large by the action of the orifice 43, the ink viscosity resistance R can be made larger and the value of γ can be relatively easily made larger. Therefore, an optimal $\gamma^2/\omega^2$ can be obtained by low-viscosity ink as compared with the first and second embodiments.

Generally, when the ink viscosity is large, ink mist easily occurs at the time of ink discharge. The occurrence of ink mist contaminates the vicinity of the nozzle 14 or recording medium, which is not desirable. Therefore, the fluid resistor is provided as in the third embodiment so that the occurrence of ink mist can be reduced at the time of printing.

Although $\gamma^2/\omega^2$ is selected such that the return time of the meniscus is made shortest in the above first to third embodiments, the ink viscosity changes and $\gamma^2/\omega^2$ varies according to the temperature of the air in which the inkjet head 10, 100 operates. Alternatively, there may be a case where $\gamma^2/\omega^2$ for making the return time of the meniscus shortest cannot necessarily be selected, depending on the design of the inkjet head 10, 100. Even in such a case, as shown in FIG. 8, the return time of the meniscus can be reduced when $\gamma^2/\omega^2$ is within the range of 0.2 to 1.0, and both the stability of the ink discharge and the speedup of the printing speed can be achieved.

Further, the ink inertia M and the ink viscosity resistance R are calculated using relatively simple equations in each embodiment, but the calculation of these values is difficult in some cases. Even in this case, the ink inertia M or the ink viscosity resistance R can be obtained by using a commercially available numerical fluid analysis program.

A method for finding the ink inertia M or the ink viscosity resistance R using the numerical fluid analysis program is disclosed in, for example, A Study on the Improvement of the Performance in Ink Jet Head (Final Program and Proceedings of IS & T's NIP15: International Conference on Digital Printing Technologies, 1999) by Sung-Cheon Jung et al.

Furthermore, the orifice 43 having a small hole as the fluid resistor is used in each embodiment, but various types, such as meshed ones, porous ones, and the like at a position where the ink flows in from the common ink chamber 17 to each pressure generating chamber 16 can be applied as the fluid resistor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet head comprising:

a plurality of flow passages each composed of a nozzle to discharge ink and a pressure generating chamber communicating to the nozzle;

a common ink chamber which supplies ink to each of the flow passages; and an actuator which expands/contracts a volume of the pressure generating chamber, wherein the physical properties of the ink and one_of said plurality of flow passages satisfy a relationship of $0.2\leqq\gamma^2/\omega^2\leqq1.0$, wherein $\gamma=R/2M$, $\omega=\sqrt{K/M}$, where M is inertia of the ink in the flow passages when the ink is charged in the flow passage, R is a viscosity resistance of the ink in the flow passages, and K is the return force of the meniscus.

2. An inkjet head according to claim 1, wherein a fluid resistor is intervened between the pressure chamber of the flow passage and the common ink chamber.

3. An inkjet recording apparatus comprising:

a plurality of flow passages each composed of a nozzle to discharge ink and a pressure generating chamber communicating to the nozzle;

a common ink chamber which supplies ink to each of the flow passages;

an actuator which expands/contracts a volume of the pressure generating chamber; and a drive signal generating portion which outputs a drive signal for continuously discharging a plurality of ink drops from the nozzle to the actuator, wherein the physical properties of the ink and one of said plurality of flow passages satisfy a relationship of $0.2\leqq\gamma^2/\omega^2 1.0$, wherein $\gamma=R/2M$, $\omega=\sqrt{K/M}$, where M is inertia of the ink in the flow passages when the ink is charged in the flow passage, R is a viscosity resistance of the ink in the flow passages, and K is the return force of the meniscus.

4. An inkjet recording apparatus comprising:

a plurality of flow passages each composed of a nozzle to discharge ink and a pressure generating chamber communicating to the nozzle;

a common ink chamber which supplies ink to each of the flow passages;

a fluid resistor provided between the pressure generating chamber of the flow passage and the common ink chamber;

an actuator which expands/contracts a volume of the pressure generating chamber; and a drive signal generating portion which outputs a drive signal for continuously discharging a plurality of ink drops from the nozzle to the actuator, wherein the physical properties of the ink and one of said plurality of flow passages satisfy a relationship of $0.2 \leqq \gamma^2/\omega^2 \leqq 1.0$, wherein $\gamma = R/2M$, $\omega = \sqrt{K/M}$, where M is inertia of the ink in the flow passages when the ink is charged in the flow passage, and R is a viscosity resistance of the ink in the flow passages, and K is the return force of the meniscus.

* * * * *